US008605032B2

(12) United States Patent
Liu et al.

(10) Patent No.: US 8,605,032 B2
(45) Date of Patent: Dec. 10, 2013

(54) ELECTROPHORETIC DISPLAY WITH CHANGEABLE FRAME UPDATING SPEED AND DRIVING METHOD THEREOF

(75) Inventors: Chun-Ting Liu, Hsinchu County (TW); Hsu-Ping Tseng, Hsinchu County (TW); Yao-Jen Hsieh, Hsinchu County (TW); Chi-Mao Hung, Hsinchu (TW)

(73) Assignee: SiPix Technology Inc., Taoyuan County (TW)

( * ) Notice: Subject to any disclaimer, the term of this patent is extended or adjusted under 35 U.S.C. 154(b) by 80 days.

(21) Appl. No.: 13/172,854

(22) Filed: Jun. 30, 2011

(65) Prior Publication Data

US 2012/0001958 A1 Jan. 5, 2012

(30) Foreign Application Priority Data

Jun. 30, 2010 (TW) ..... 99121475 A

(51) Int. Cl.
*G09G 3/34* (2006.01)

(52) U.S. Cl.
USPC ..... 345/107

(58) Field of Classification Search
USPC ..... 345/107, 214, 690
See application file for complete search history.

(56) References Cited

U.S. PATENT DOCUMENTS

| | | | | |
|---|---|---|---|---|
| 2009/0128585 | A1 | 5/2009 | Shimodaira | |
| 2009/0174690 | A1 * | 7/2009 | Song et al. | 345/204 |
| 2009/0189884 | A1 * | 7/2009 | Maeda | 345/214 |
| 2009/0278774 | A1 * | 11/2009 | Chen et al. | 345/83 |

FOREIGN PATENT DOCUMENTS

| | | |
|---|---|---|
| CN | 1928959 | 3/2007 |
| CN | 101499238 | 8/2009 |
| TW | 200746006 | 12/2007 |
| TW | 200948096 | 11/2009 |

OTHER PUBLICATIONS

"Office Action of Taiwan Counterpart Application", issued on Aug. 27, 2013, p1-p8, in which the listed references were cited.

* cited by examiner

*Primary Examiner* — Chanh Nguyen
*Assistant Examiner* — Jonathan Blancha
(74) *Attorney, Agent, or Firm* — Jianq Chyun IP Office

(57) ABSTRACT

An electrophoretic display and a driving method thereof are provided. The electrophoretic display includes a display panel, a storage unit, a timing controller (TCON). The display panel has a plurality of sub-pixels. The storage unit stores a plurality sets of driving waveforms, wherein the lengths of driving waveforms in the sets of driving waveforms are different from each other. The TCON has an analysis module, couples to the display panel and the storage unit, and receives an image signal having a plurality of display data. The analysis module analyzes the display data to obtain a analysis result. The TCON selects one of the sets of driving waveforms according to the analysis result, and drives the sub-pixels according to the selected set of driving waveforms.

11 Claims, 2 Drawing Sheets

ELECTROPHORETIC DISPLAY WITH CHANGEABLE FRAME UPDATING SPEED AND DRIVING METHOD THEREOF

CROSS-REFERENCE TO RELATED APPLICATION

This application claims the priority benefit of Taiwan application serial no. 99121475, filed on Jun. 30, 2010. The entirety of the above-mentioned patent application is hereby incorporated by reference herein and made a part of this specification.

BACKGROUND OF THE INVENTION

1. Field of the Invention

The present invention relates to a display, and more particularly to an electrophoretic display and a driving method thereof.

2. Description of Related Art

Currently, with progress in various technologies of displays, after the technologies are continuously developed, the displaying products such as electrophoretic displays, liquid crystal displays, plasma displays and organic-light-emitting-diode displays are gradually commercialized and are applied on the display devices with various sizes and displaying areas. With the popularity of the portable electronic products, the flexible displays (such as the e-papers, the e-books etc.) gradually attract the attention. Generally, the displaying mechanisms of the e-papers and the e-books are based on the electrophoretic technology. Taking the e-book as an example, the sub-pixels of the e-book are composed of the electrophoretic fluid with various colors (such as red, green, blue, etc.) and white electronic particles in the electrophoretic fluid. By applying voltage onto the sub-pixels, the white electronic particles are driven to move so that pixels respectively display black, white, red, green, blue or the colors with different levels.

In the currently technologies, the electrophoretic display uses the reflection of the external light source to display image. More specifically, the colors of the electrophoretic fluids determine the colors displayed by the sub-pixels respectively and the gray scales of the sub-pixels can be controlled by using the driving waveform to drive the white electronic particles in the electrophoretic fluids. Wherein, the gray scale of each of the sub-pixels is correlated with the ratio of the driving voltage of the driving waveform to the non-driving voltage. Further, for each of the sub-pixels, in order to display each one of the gray scales, the driving waveform possesses a fixed length. That is, the driving time for each sub-pixel is fixed. Therefore, page changing speed of the electrophoretic display is fixed.

SUMMARY OF THE INVENTION

The invention provides an electrophoretic display and a driving method thereof which are capable of improving the frame updating speed.

The present invention provides an electrophoretic display having a display panel, a storage unit and a timing controller. The display panel has a plurality of sub-pixels. The storage unit stores a plurality sets of driving waveforms, wherein lengths of the driving waveforms in the sets of driving waveforms are different from each other. The timing controller has an analysis module, and the timing controller is coupled to the storage unit and the display panel and the timing controller receives an image signal having a plurality of display data.

The analysis module analyzes the display data to obtain an analysis result, and the timing controller selects one of the sets of driving waveforms according to the analysis result and drives the sub-pixels according to the selected set of driving waveforms.

According to one embodiment of the present invention, the electrophoretic display further comprises a signal processing unit coupling to the timing controller and receiving a video signal so as to generate the image signal according to the video signal.

The present invention also provides a method of driving an electrophoretic display. The method comprises the following steps. An image signal having a plurality of display data is received. The display data is analyzed to obtain an analysis result. One of the sets of driving waveforms is selected according to the analysis result, wherein lengths of the driving waveforms in the sets of driving waveforms are different from each other. A plurality of sub-pixels of a display panel of the electrophoretic display are driven according to the selected set of driving waveforms.

According to one embodiment of the present invention, the analysis result including a sum of a first scale corresponding to a first gray scale and a second scale corresponding to a second gray scale.

According to one embodiment of the present invention, the first gray scale and the second gray scale respectively denote the highest gray scale and the lowest gray scale of a gray scale range represented by the image signal.

According to one embodiment of the present invention, the first scale is $H1=G1/S\times100\%$, and G1 denotes an amount of a portion of the display data corresponding to the first gray scale and S denotes an amount of the display data.

According to one embodiment of the present invention, the second scale is $H2=G2/S\times100\%$, and G2 denotes an amount of a portion of the display data corresponding to the second gray scale and S denotes an amount of the display data.

Accordingly, in the electrophoretic display and the driving method of the present invention, the display data of the image signal is analyzed to obtain the analysis result and one of the sets of driving waveforms in which the lengths of the driving waveforms are different from each other is selected according to the analysis result. Moreover, the sub-pixels of the display panel of the electrophoretic display are driven according to the selected set of driving waveforms. Therefore, under the circumstance that the analysis result reveals the gray scale distribution range of the frame is relatively small, the driving waveform with relatively short length can be selected to improve the frame updating speed.

In order to make the aforementioned and other features and advantages of the invention more comprehensible, embodiments accompanying figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
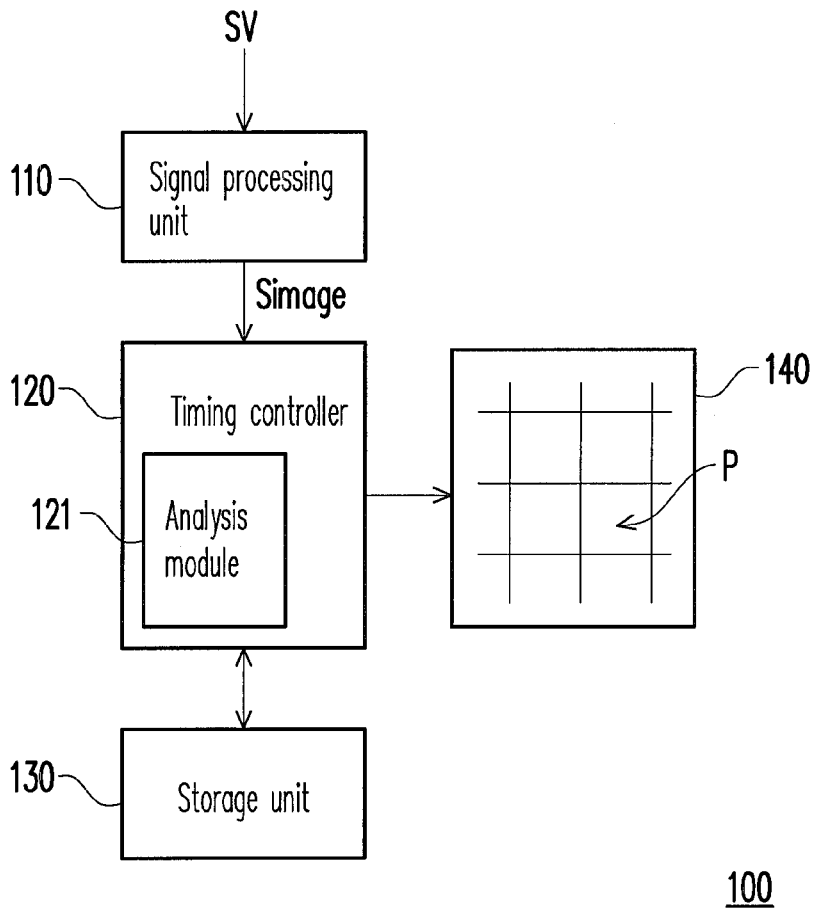
FIG. 1 is a schematic diagram of a system of an electrophoretic display according to one embodiment of the present invention.

FIG. 1 is a schematic diagram of a system of an electrophoretic display according to one embodiment of the present invention. As shown in FIG. 1, in the present embodiment, an electrophoretic display 100 comprises a signal processing unit 110, a timing controller (TCON) 120, a storage unit 130 and a display panel 140. The timing controller 120 further comprises an analysis module. The display panel 140 has a plurality of sub-pixels P. The signal processing unit 110 receives a video signal SV and generates an image signal Simage according to the video signal SV. The image signal Simage is used to transmit a plurality of data of a frame. The storage unit 130 stores a plurality sets of driving waveforms, wherein lengths of the driving waveforms in the sets of driving waveforms are different from each other. Moreover, in the form of function, the storage unit 130 can be regarded as a Look-Up table (LUT).

The timing controller 120 is coupled to the signal processing unit 110, the storage unit 130 and the display panel 140. The analysis module 121 analyzes the image signal to obtain the analysis result and determines a gray scale distribution range of the frame according to the analysis result. The timing controller 120 selects one of the sets of driving waveforms according to the gray scale distribution range of the frame (i.e. the analysis result) and drives the sub-pixels P of the display panel 140 according to the selected set of driving waveforms.

More clearly, the analysis module 121 analyzes the display data transmitted by the image signal Simage to obtain the histogram data of each of the gray scales as well as the scales respectively corresponding to the gray scales. Moreover, the first scale corresponding to the highest gray scale and the second scale corresponding to the lowest gray scale are summed up and the sum of the first scale and the second scale as the analysis result, for instance. The first scale corresponding to the highest gray scale is $H1=G1/S\times100\%$, wherein G1 denotes an amount of a portion of the display data corresponding to the first gray scale and S denotes an amount of the display data. The second scale corresponding to the lowest gray scale is $H2=G2/S\times100\%$, wherein G2 denotes an amount of a portion of the display data corresponding to the second gray scale. Taking the frame with 16 gray scales as an example, the highest gray scale is 15 and the lowest gray scale is 0. The analysis module 121 calculates the scales respectively corresponding to the gray scale 0 and gray scale 15 and sums up the scales to be the analysis result.

Thereafter, after the analysis result is obtained, the timing controller 120 selects a set of driving waveform according to the analysis result and drives the sub-pixels of the display panel 140 according to the driving waveforms in the selected set of driving waveforms. The timing controller 120 can set at least a threshold to be a basis for determining the gray scale distribution range of the frame represented by the analysis result, and the amount of the sets of driving waveforms stored in the storage unit 130 corresponds to the amount of the threshold. For instance, if the amount of the threshold is one, the storage unit 130 stores at least two sets of driving waveforms. If the amount of the threshold is two, the storage unit 130 stores at least three sets of driving waveforms. Others can be deduced by applying the same and are not described herein.

Moreover, since the lengths of the driving waveforms in the sets of driving waveforms stored in the storage unit 130 are difference from each other, the driving time of the sub-pixels P of the display panel 140 is as same as the conventional driving time when the timing controller 120 selects the set of driving waveforms having the longest length of the driving waveform and length of the driving waveform of the selected set of driving waveform is as same as the length of the conventional driving waveform. In other words, the frame updating speed is unchanged. However, when the timing controller 120 selects other sets of driving waveforms, the driving time of the sub-pixels P of the display panel 140 is smaller than the conventional driving time due to the length of the driving waveform of the selected other set of driving waveform smaller than the length of the conventional driving waveform. That is, the frame updating speed is faster.

Taking setting one threshold as an example, the amount of the sets of driving waveforms stored in the storage unit 130 is more than two (herein, two is only taken as an example) and the threshold is 50%, for example but not limited to. Therefore, if the analysis result is smaller than 50%, which means the gray scale distribution range of the frame is relatively large (i.e. the frame is a multiple gray scale frame), the timing controller 120 selects the set of driving waveform having relatively large length of the driving waveform. Otherwise, if the analysis result is larger than or equal to 50%, which means the gray scale distribution range of the frame is relatively small (i.e. the frame is a less gray scale frame), the timing controller 120 selects the set of driving waveform having relatively small length of the driving waveform. Thus, the frame updating speed can be improved.

Taking setting two thresholds as an example, the amount of the sets of driving waveforms stored in the storage unit 130 is more than three (herein, three is only taken as an example) and the thresholds are 50% and 100%, for example but not limited to. Therefore, if the analysis result is smaller than 50%, which means the gray scale distribution range of the frame is relatively large (i.e. the frame is a multiple gray scale frame), the timing controller 120 selects the set of driving waveform having the largest length of the driving waveform. Alternatively, if the analysis result is larger than 50% and smaller than 100%, which means the gray scale distribution range of the frame is relatively small (i.e. the frame is a less gray scale frame), the timing controller 120 selects the set of driving waveform having the second large length of the driving waveform so that the frame updating speed can be slightly improved. Furthermore, if the analysis result is equal to 100%, which means the gray scale distribution range of the frame covers two gray scales (i.e. the frame is a two-gray-scale frame), the timing controller 120 selects the set of driving waveform having smallest length of the driving waveform so that the frame updating speed can be greatly improved. In addition, other circumstances for setting the threshold can be deduced by applying the same mentioned above and are not described herein.

Figure 2:
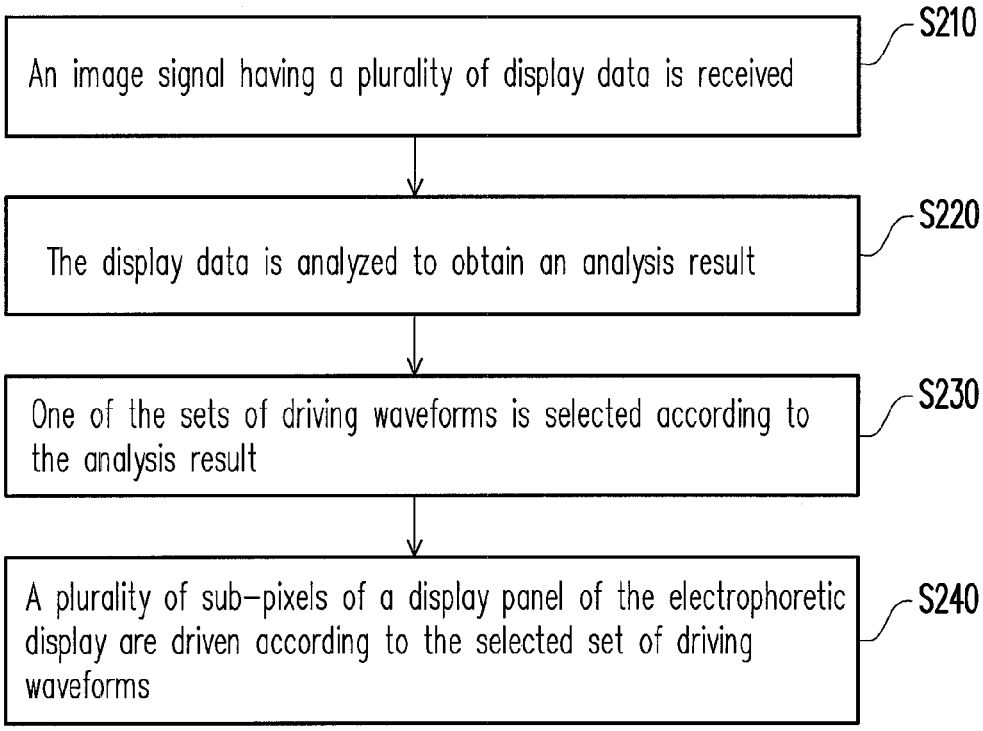
FIG. 2 is a flowchart of a method for driving an electrophoretic display according to one embodiment of the invention.

Accordingly, a driving method for the electrophoretic display 100 is provided in the following descriptions. FIG. 2 is a flowchart of a method for driving an electrophoretic display according to one embodiment of the invention. As shown in FIG. 2, in the present embodiment, an image signal having a plurality of display data is received (step S210). Then, the display data is analyzed to obtain an analysis result (step S220) and one of the sets of driving waveforms is selected according to the analysis result (step S230), wherein lengths of the driving waveforms in the sets of driving waveforms are different from each other. Thereafter, a plurality of sub-pixels of a display panel of the electrophoretic display are driven according to the selected set of driving waveforms (step S240). The details of aforementioned steps can be referenced to the above descriptions and are not described herein.

Accordingly, in the electrophoretic display and the driving method of the embodiments of the present invention, the display data of the image signal is analyzed to obtain the analysis result and one of the sets of driving waveforms in which the lengths of the driving waveforms are different from each other is selected according to the analysis result. Moreover, the sub-pixels of the display panel of the electrophoretic display are driven according to the selected set of driving waveforms. Therefore, under the circumstance that the analysis result reveals the gray scale of the frame is relatively less, the driving waveform with relatively short length can be selected to improve the frame updating speed.

Although the invention has been described with reference to the above embodiments, it will be apparent to one of the ordinary skill in the art that modifications to the described embodiment may be made without departing from the spirit of the invention. Accordingly, the scope of the invention will be defined by the attached claims not by the above detailed descriptions.

What is claimed is:

1. An electrophoretic display, comprising:

a display panel having a plurality of sub-pixels;

a storage unit storing a plurality sets of driving waveforms, wherein lengths of the driving waveforms in the sets of driving waveforms are different from each other, and the lengths of the driving waveforms in the same set of driving waveforms are identical; and a timing controller having an analysis module, coupling to the display panel and the storage unit, and receiving an image signal having a plurality of display data corresponding to a frame with a plurality of gray-scales, wherein the analysis module analyzes the display data to obtain a analysis result, and the timing controller selects one of the sets of driving waveforms according to the analysis result and drives the sub-pixels according to the selected set of driving waveforms, wherein when the frame is a high multiple gray scale level frame, the timing controller selects the set of driving waveforms having the larger length, and wherein when the frame is a less gray scale level frame than the high multiple gray scale level frame, the timing controller selects the set of driving waveforms having smaller length.

2. The electrophoretic display of claim 1, wherein the analysis result includes a sum of a first scale corresponding to a first gray scale and a second scale corresponding to a second gray scale.

3. The electrophoretic display of claim 2, wherein the first gray scale and the second gray scale respectively denote the highest gray scale and the lowest gray scale of a gray scale range represented by the image signal.

4. The electrophoretic display of claim 2, wherein the first scale is $H1=G1/S\times100\%$, and G1 denotes an amount of a portion of the display data corresponding to the first gray scale and S denotes an amount of the display data.

5. The electrophoretic display of claim 2, wherein the second scale is $H2=G2/S\times100\%$, and G2 denotes an amount of a portion of the display data corresponding to the second gray scale and S denotes an amount of the display data.

6. The electrophoretic display of claim 1, further comprising:

a signal processing unit coupling to the timing controller and receiving a video signal so as to generate the image signal according to the video signal.

7. A method of driving an electrophoretic display, comprising:

receiving an image signal having a plurality of display data corresponding to a frame with a plurality of gray-scales;

analyzing the display data to obtain an analysis result;

selecting one of a plurality sets of driving waveforms according to the analysis result, wherein lengths of the driving waveforms in the sets of driving waveforms are different from each other, wherein the lengths of the driving waveforms in the same set of driving waveforms are identical; and driving a plurality of sub-pixels of a display panel of the electrophoretic display according to the selected set of driving waveforms, wherein when the frame is a high multiple gray scale level frame, the timing controller selects the set of driving waveforms having the larger length, and wherein when the frame is a less gray scale level frame than the high multiple gray scale level frame, the timing controller selects the set of driving waveforms having smaller length.

8. The method of claim 7, wherein the analysis result includes a sum of a first scale corresponding to a first gray scale and a second scale corresponding to a second gray scale.

9. The method of claim 8, wherein the first gray scale and the second gray scale respectively denote the highest gray scale and the lowest gray scale of a gray scale range represented by the image signal.

10. The method of claim 8, wherein the first scale is $H1=G1/S\times100\%$, and G1 denotes an amount of a portion of the display data corresponding to the first gray scale and S denotes an amount of the display data.

11. The method of claim 8, wherein the second scale is $H2=G2/S\times100\%$, and G2 denotes an amount of a portion of the display data corresponding to the second gray scale and S denotes an amount of the display data.

* * * * *